US007079097B2

(12) United States Patent
Lee

(10) Patent No.: US 7,079,097 B2
(45) Date of Patent: Jul. 18, 2006

(54) LIQUID CRYSTAL DISPLAY AND DRIVING METHOD THEREOF

(75) Inventor: Seung-Woo Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 442 days.

(21) Appl. No.: 10/422,516

(22) Filed: Apr. 24, 2003

(65) Prior Publication Data

US 2004/0021625 A1 Feb. 5, 2004

(30) Foreign Application Priority Data

Apr. 24, 2002 (KR) ..... 2002-0022494

(51) Int. Cl.
*G09G 3/36* (2006.01)

(52) U.S. Cl. ..... 345/87; 345/691; 345/99; 345/78

(58) Field of Classification Search ..... 345/99, 345/691, 87
See application file for complete search history.

(56) References Cited

U.S. PATENT DOCUMENTS 6,727,878 B1 * 4/2004 Okuzono et al. ..... 345/96
2003/0160753 A1 * 8/2003 McCartney ..... 345/99

* cited by examiner

*Primary Examiner*—Kent Chang
*Assistant Examiner*—Seokyun Moon
(74) *Attorney, Agent, or Firm*—Cantor Colburn LLP

(57) ABSTRACT

The present invention provides an LCD capable of being driven with various frequencies without deterioration of image quality. According to the present invention, a method of driving an LCD in two-dot inversion for a low vertical frequency and in one-dot inversion for a high vertical frequency is provided. The method determines whether the vertical frequency of the LCD changes, changes the inversion type into one-dot inversion if the vertical frequency is changed from a low frequency to a high frequency, and changes the inversion type into two-dot inversion if the vertical frequency is changed from a high frequency to a low frequency. Moreover, if a flicker is generated when driving in one-dot inversion, the inversion type is changed into two-dot inversion. To avoid the unequal charging generated in the LCD driven in two-dot inversion, the pulse width of the gate signals are adjusted after measuring the load of the data line.

3 Claims, 4 Drawing Sheets

| Frame → | | | | |
|---|---|---|---|---|
| 1 | 2 | 3 | 4 | 5 |
| + | − | + | − | + |
| − | + | − | + | − |
| + | − | + | − | + |
| − | + | − | + | − |
| + | − | + | − | + |
| − | + | − | + | − |
| + | − | + | − | + |
| − | + | − | + | − |

| Frame → | | | | |
|---|---|---|---|---|
| 1 | 2 | 3 | 4 | 5 |
| + | − | + | − | + |
| + | − | + | − | + |
| − | + | − | + | − |
| − | + | − | + | − |
| + | − | + | − | + |
| + | − | + | − | + |
| − | + | − | + | − |
| − | + | − | + | − |

LIQUID CRYSTAL DISPLAY AND DRIVING METHOD THEREOF

BACKGROUND OF THE INVENTION (a) Field of the Invention

The present invention relates to a liquid crystal display and a driving method thereof.

(b) Description of Related Art

A liquid crystal display (LCD) includes an upper panel provided with a common electrode and color filters, a lower panel provided with thin film transistors (TFTs) and pixel electrodes, and a liquid crystal layer interposed between alignment layers of the panels. The LCD displays images by controlling light transmittance, and the control of the light transmittance is performed by applying voltages to the pixel electrodes and the common electrode to generate electric fields which change the arrangement of liquid crystal molecules.

One-dot inversion and two-dot inversion is used for driving the LCD. Both of one-dot and two-dot inversion apply a data signal in a frame having a polarity opposite that of a data signal in a previous frame.

One-dot inversion applies a data signal to a pixel connected to a previous gate line and a data signal to a pixel connected to a present gate line such that the polarity of the two data signals are opposite as shown in FIG. 6A.

Two-dot inversion reverses the polarity of data signals applied to two pixels connected to two gate lines with respect to data signals applied to two pixels connected to previous two gate lines. According to an exemplary two-dot inversion shown in FIG. 6B, if the polarity of a data signal applied to a pixel connected to a current gate line is the same as that of a data signal applied to a pixel connected to a previous gate line, the polarity of a data signal applied to a pixel connected to the next gate line is opposite to that of the data signal applied to the pixel connected to the current gate line.

As the application field of LCDs extends to computer monitors, televisions, etc. which conventional cathode ray tubes (CRTs) have occupied, there occurred the needs for supporting various resolutions and screen scan rates. However, since a conventional LCD has a fixed vertical frequency unlike the CRT, transformations of resolution and scan rate using scale engine and frame memory are required to support various resolutions such as VGA (640×480), SVGA (800×600), XGA (1024×768), SXGA (1280×1024), UXGA (160×1200), etc. and various scan rates such as 60 Hz, 70 Hz, 72 Hz, 75 Hz, 85 Hz, etc.

The recent techniques try to make LCDs support various vertical frequencies by removing frame memory from the LCDs. However, high frequency driving of the LCDs reduces pulse width of gate signals, and the reduction of the gate pulse width in an LCD with the above-described two-dot inversion generates horizontal lines.

In detail, high frequency driving of an LCD results in reduction of the pulse width of the gate signal. If the pulse width of the gate signal is reduced and the load of the data lines is large, a pixel supplied with a data signal having reversed polarity is not sufficiently charged due to the heavy load of the data line. That is, there is unequal charging between pixels connected to the odd-numbered gate lines supplied with the data signal having reversed polarity and those connected to the even-numbered gate lines supplied with the data signal having non-inverted polarity. This charging inequality results in the horizontal line pattern causing poor image quality. This horizontal line pattern also appears in an LCD using 4 mask panel even if it is driven with 60 Hz.

Although it is suggested to use one-dot inversion in the LCD driven with high frequency for avoiding such horizontal line pattern, a dot pattern called flicker is occurred. The flicker is generated when the wave forms of a positive voltage and a negative voltage applied to the liquid crystal are not symmetric. That is, a flicker is a twinkling phenomenon due to the variation of the gray having a period equal to the period of the alternating voltage applied to the pixel electrode because the light transmittance for the positive voltage is different from that for the negative voltage.

SUMMARY OF THE INVENTION

An object of the present invention is to adjust pulse width of gate signals depending on load of data lines. Another object of the present invention is to remove the flicker of an LCD driven in one-dot inversion. In addition, the present invention has another object to change the inversion type when the vertical frequency of the LCD changes.

According to a first aspect of the present invention, an LCD including a liquid crystal panel and a timing controller is provided. The LCD panel includes a first data line and a plurality of second data lines extending parallel to each other in a column direction and a plurality of gate lines extending parallel to each other in a row direction. The LCD panel further includes a signal line extending in the row direction and connected to the first data line. The timing controller is electrically connected to the first and the second data lines, the gate lines, and the signal line and controls timing of image signals and selection signals respectively applied to the second data lines and the gate lines. The timing controller applies a first pulse to the first data line, receives a second pulse as a delayed signal of the first pulse through the signal line, and measures a load of the second data line based on the delay between the first pulse and the second pulse. A pulse width of a gate signal applied to a previous gate line is narrower than a pulse width of a gate signal applied to a current gate line adjacent to the previous gate line in case that polarities of the gate signals of the previous and the current gate lines are opposite if the measured load is large.

The first data line may include a dummy data line. Alternatively, the first data line includes a data line transmitting an image signal and the signal line includes any one of gate lines connected to the data line.

According to a second aspect of the present invention, a driving method of an LCD in a first dot inversion giving opposite polarities to adjacent pixels is provided.

According to this method, it is determined if an area occupied by patterns where a gray difference between two adjacent pixels representing a color among a predetermined number of successive pixels is larger than a predetermined range is equal to or larger than a predetermined area with respect to the entire pixels. The first dot inversion is substituted with a second dot inversion if the patterns occupy the predetermined area. Preferably, the second dot inversion includes two-dot inversion.

First, the entire pixels having a color are grouped into a plurality of blocks including a predetermined number of pixels having the color in a line, and it is determined if all of the gray differences between two adjacent pixels in one block are larger than the predetermined range. It is then determined if the patterns of any one of red, green and blue colors having the gray differences larger than the predetermined range occupy the predetermined area.

According to a third aspect of the present invention, an LCD implementing the driving method according to the second aspect is provided. The LCD includes a liquid crystal panel having a plurality of data lines and gate lines and a plurality of pixels in a matrix for displaying images based on signals from the data lines and the gate lines. In addition, the LCD further includes a timing controller which performs the determination according to the second aspect.

According to a fourth aspect of the present invention, a driving method of an LCD in two-dot inversion for low vertical frequency and in one-dot inversion with high vertical frequency is provided. According to this method, it is determined that a vertical frequency from outside is high or low, and the LCD is driven in one-dot inversion for a low frequency and in two-dot inversion for a high frequency. When a flicker is generated, the inversion type is changed from one-dot inversion to two-dot inversion.

According to a fifth aspect of the present invention, an LCD implementing the driving method according to the fourth aspect is provided. The LCD includes a liquid crystal panel having a plurality of data lines, a plurality of gate lines and a plurality of pixels in a matrix displaying images based on signals from the data lines and the gate lines. In addition, the LCD further includes a timing controller changing the inversion type according to the fourth aspect.

The timing controller may determine the vertical frequency by counting a length of one frame or an active period or an inactive period of a data enable signal (DE) using an internal clock.

Alternatively, the LCD additionally includes a ring oscillator generating a clock having a fixed frequency, and the timing controller can determine the vertical frequency by counting a length of one frame or an active period or an inactive period of a data enable signal (DE) using a clock of the ring oscillator.

BRIEF DESCRIPTION OF THE DRAWINGS

FIG. 6 shows one-dot inversion and two-dot inversion; and

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein.

Now, LCDs and driving methods thereof according to embodiments of the present invention are described in detail with reference to accompanying drawings.

First, an LCD according to a first embodiment of the present invention will be described with reference to FIGS. 1 and 3.

Figure 1:
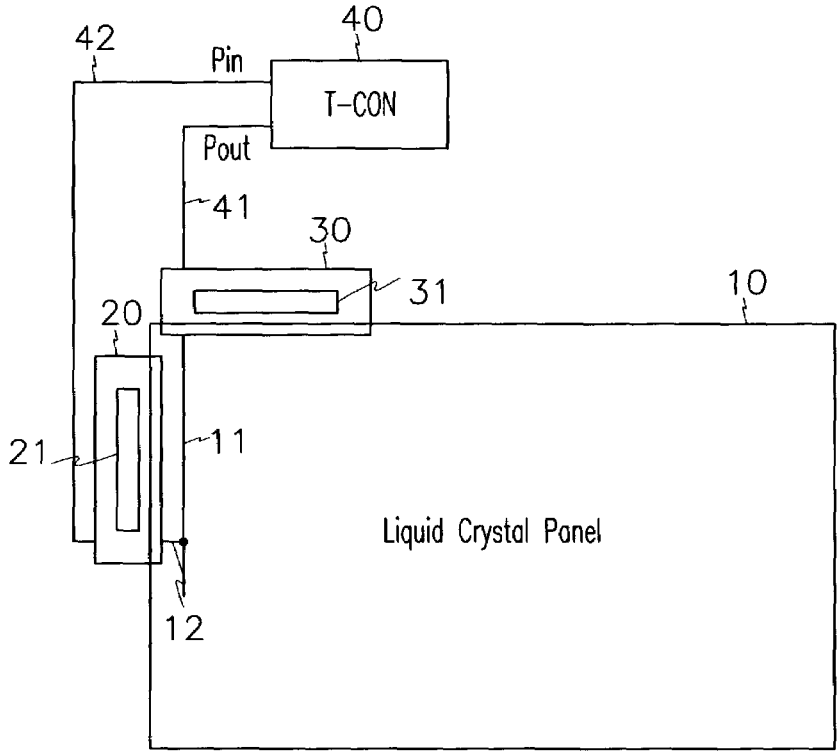
FIG. 1 is a schematic layout diagram of an LCD according to the first embodiment of the present invention.
Figure 2:
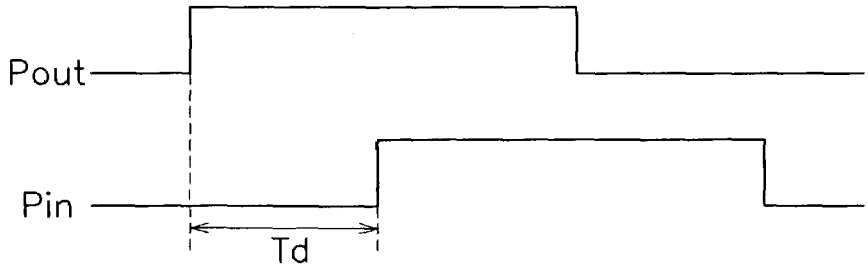
FIG. 2 is a diagram showing waveforms of pulses used for measuring the load of a data line according to a first embodiment of the present invention.

FIG. 1 is a schematic layout diagram of an LCD according to the first embodiment of the present invention. FIG. 2 is a diagram showing waveforms of pulses used for measuring load of a data line according to the first embodiment of the present invention, and FIG. 3 is a diagram showing waveforms of gate signals having pulse widths adjusted according to the first embodiment of the present invention.

Referring to FIG. 1, an LCD according to the first embodiment of the present invention includes a liquid crystal panel 10, gate and data tape carrier packages ("TCPs") 20 and 30 connected to upper and left ends of the liquid crystal panel 10, respectively, and a timing controller ("T-CON") 40 connected to the TCPs 20 and 30 via respective lid lines (not shown).

A plurality of gate lines (not shown) transmitting scanning signals or gate signals extending in a transverse direction and a plurality of data lines (not shown) transmitting image signals or data signals extending in a longitudinal direction are provided on the liquid crystal panel 10. In addition, a plurality of pixels (not shown) displaying images in response to the signals from the gate lines and data lines are provided on the liquid crystal panel 10 and arranged in a matrix.

A gate driver integrated circuit (IC) 21 and a data driver IC 31 are mounted on the gate and the data TCPs 20 and 30, respectively, and a plurality of lid lines (not shown) connected to the data driver ICs 21 and 31 are formed on the TCPs 20 and 30. The TCPs 20 and 30 are attached to the liquid crystal panel 10 and connected to the gate lines and the data lines. The driver ICs 21 and 31 may be mounted directly on a TFT array panel (not shown) of the liquid crystal panel 10 instead of mounting on the TCPs 20 and 30, which is called COG (chip on glass) type.

The timing controller 40 generates timing signals for driving the gate and the data driver ICs 21 and 31, and transmits them to the gate and the data driver ICs 21 and 31 via the lid lines. The gate driver IC 21 transmits the scanning signals or the gate signals based on the timing signals and voltages provided from the gate driving voltage generator (not shown) to the gate lines, and the data driver IC 31 transmits the image signals or the data signals based on the timing signals and voltages provided from the gray voltage generator (not shown) to the data lines.

A dummy data line 11 is additionally provided on the liquid crystal panel 10 according to the first embodiment of the present invention. The dummy data line 11 is connected to the data TCP 30 and electrically connected to the timing controller 40 through a lid line 41 connected to the TCP 30. The dummy data line 11 is connected to the gate TCP 20 through a signal line 12 horizontally connected thereto, and electrically connected to the timing controller 40 through a lid line 42 connected to the TCP 20. The signal line 12 may be connected to an end of the dummy data line 11 or an intermediate point of the dummy data line 11.

According to the first embodiment of the present invention, the timing controller 40 outputs a pulse Pout for measuring the load of the data lines to the dummy data line 11 via the TCP 30. Then, the pulse Pout is delayed by the load of the dummy data line 11 and transmitted to the signal line 12, and the delayed pulse Pin enters into the timing controller 40 through the TCP 20 via the lid line 42.

As shown in FIG. 2, the timing controller 40 measures the load of the data line by calculating the time difference Td between the initial pulse Pout and the delayed pulse Pin due to the dummy data line 11. The load of the data line is determined to be larger as the time difference is larger.

Figure 3:
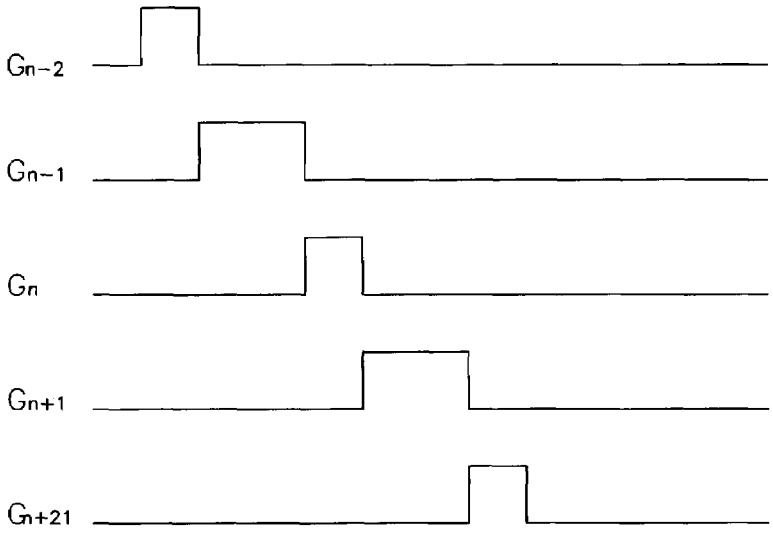
FIG. 3 is a diagram showing gate signals having pulse widths adjusted according to the first embodiment of the present invention.

As shown in FIG. 3, the pulse widths of the gate signals applied to the gate lines connected to the pixels supplied with the data signal of reversed polarity are widen, while those of the gate signals applied to other gate lines are narrowed when the load of the data line is determined to be large. For example, the signals applied to the pixels connected to the gate lines $G_{n-1}$ and $G_{n+1}$ have reversed polarity with respect to those applied to the pixels connected to the gate lines $G_{n-2}$ and $G_n$, and the signals applied to the pixels connected to the gate lines $G_n$ and $G_{n+2}$ have the same polarity as those applied to the pixels connected to the gate lines $G_{n-1}$ and $G_{n+1}$ in two-dot inversion. Therefore, as shown in FIG. 3, the pulse widths of the gate signals applied to the gate lines $G_{1-1}$ and $G_{n+1}$ is widen, and those of the gate signals applied to the gate lines $G_{n-2}$, $G_n$, and $G_{n+2}$ is narrowed.

Although the first embodiment of the present invention measures the load of the data line using a dummy data line provided on the liquid crystal panel 10, the load of the data line can be measured using a normal data line instead of the dummy data line. Now, a modified embodiment as such is described.

A modified embodiment of the first embodiment of the present invention applies a pulse for measuring the load of the data line to any one of the data lines. The timing controller 40 receives the output of the pulse from any one of the gate lines connected to the data line supplied with the pulse, and determined the load of the data line by calculating the delay of the pulse.

The first embodiment and the modified embodiment of the present invention solve the unequal charging of a two-dot inversion type LCD having large load of data lines by widening the pulse widths of the gate signals applied to the even-numbered gate lines and narrowing the pulse widths of the gate signals applied to the odd-numbered gate lines after measuring the load of the data line.

As described above, the LCD according to the first and the modified embodiments of the present invention is driven in two-dot inversion even if the vertical frequency is equal to or higher than 60 Hz, and the pulse widths of the gate signals are adjusted depending on the measured load of the data line to remove the horizontal lines. However, an LCD may be driven in one-dot inversion with high frequency unlike the first embodiment of the present invention, and such embodiments will be described with reference to the FIGS. 4 and 5.

First, a second embodiment, which drives an LCD in one-dot inversion with high frequency and changes the inversion type into two-dot inversion upon the generation of flicker, is described with reference to FIG. 4.

Figure 4:
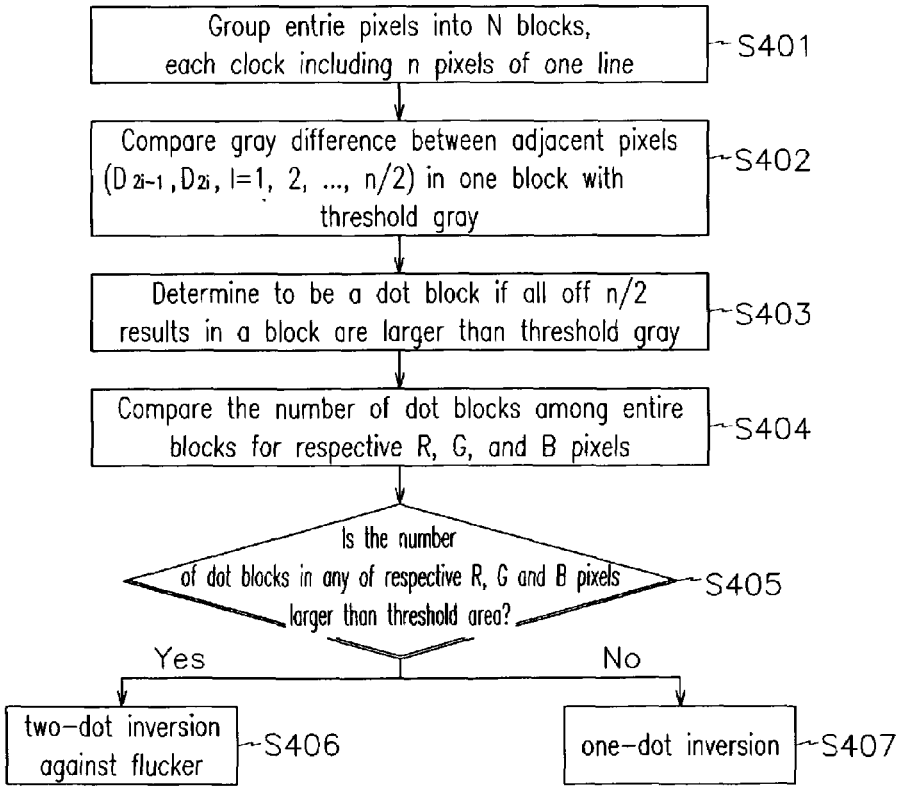
FIGS. 4 and 5 are flowcharts illustrating driving methods of an LCD according to second and third embodiments of the present invention, respectively.

FIG. 4 is a flowchart illustrating a driving method of an LCD according to the second embodiment of the present invention.

Figures 6A, 6B, 7:
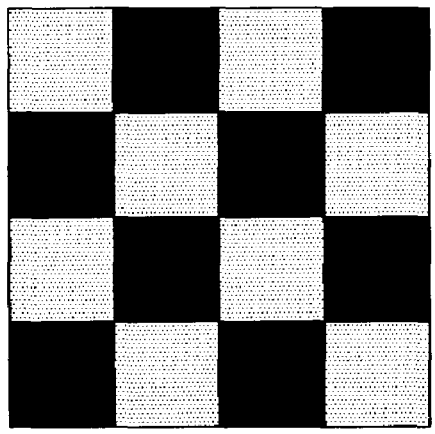
FIG. 7 illustrates a flicker of an LCD.

The second embodiment of the present invention uses one-dot inversion for an LCD driven with a frequency equal to or higher than 60 Hz such as 75 Hz. If the LCD is driven with a frequency higher than 60 Hz, flicker can be generated as shown in FIG. 7. In case that the flicker is generated, the conversion of the inversion type of the LCD into two-dot inversion avoids the deterioration of the image quality.

Now, it will be described in detail. As shown in FIG. 4, the timing controller 40 of the LCD according to the second embodiment of the present invention groups the entire pixels in the liquid crystal panel 10 into N blocks of pixels, each block including n pixels (e.g., 16 pixels in the following example) in one pixel line (indicating one pixel row or one pixel column) (S401). The timing controller 40 compares the difference of the gray of adjacent pixels in a block to a predetermined threshold gray value (S402).

$$|D_{2i}-D_{2i-1}|>D_{TH} \quad (1)$$

where $D_{2i-1}$ and $D_{2i}$ indicate the grays of the (2i−1)-th and 2i-th pixels of a block, respectively, $D_{TH}$ is the threshold gray value, and i is a number from one to eight.

If all of eight adjacent pixels satisfy Inequality 1, then this block is determined to be a dot block (S403). The total numbers of the dot blocks in the respective R, G and B pixels are calculated by repeating the steps of S402 and S403 (S404). If any one of the total numbers of the dot blocks for the respective R, G and B pixels is larger than a predetermined threshold area, then it is determined that the flicker is generated (S405).

The threshold area is a reference area which the dot blocks occupy wit h respect to an entire screen area for determining the generation of the flicker. For example, if a given threshold area is 1/10 of the entire area, then it is determined that the flicker is generated when the number of the dot blocks is 8192 in SXGA (super extended graphics adapter, 1280×1024) screen.

If it is determined that the flicker is generated, the timing controller 40 changes the inversion type of the LCD from one-dot inversion to two-dot inversion to remove the flicker, and if not, the LCD is driven in one-dot inversion.

The second embodiment of the present invention enable to drive the LCD in one-dot inversion with high frequency larger than 60 Hz and changes the inversion type into two-dot inversion upon the generation of flicker in one-dot inversion to avoid the deterioration of the image quality.

Although the second embodiment of the present invention determines whether a flicker is generated or not by grouping the entire pixels, the determination of flicker generation can be determined by another way.

As described above, the second embodiment of the present invention drives the LCD in one-dot inversion for all frequencies except for the case that the flicker is generated, which applies two-dot invention. However, an LCD is driven in two-dot inversion for a frequency of 60 Hz while in one-dot inversion for a frequency higher than 60 Hz. Now, such an embodiment is described with reference to FIG. 5.

Figure 5:
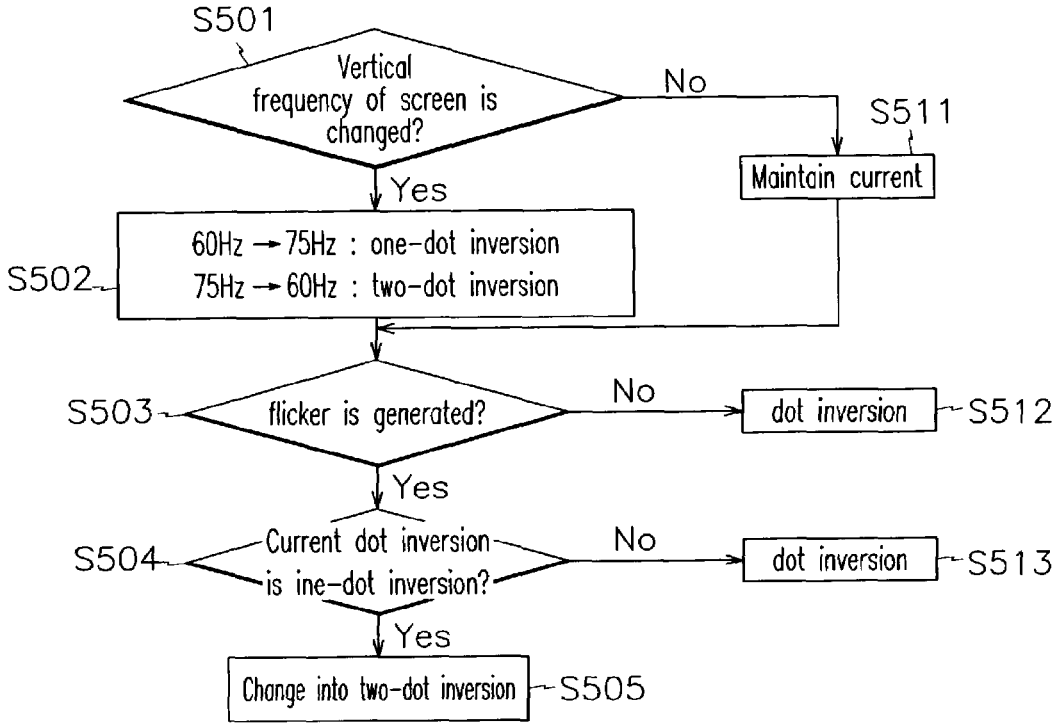

FIG. 5 is a flowchart illustrating a driving method of an LCD according to a third embodiment of the present invention.

The third embodiment of the present invention drives the LCD in two-dot inversion for 60 Hz frequency while in one-dot inversion for higher frequency such as 75 Hz. Since an LCD is usually driven with 60 Hz frequency, two-dot inversion driving of the LCD with 60 Hz frequency reduces power consumption. If the flicker is generated for the frequencies higher than 60 Hz, then the inversion type is changed into two-dot inversion to avoid the deterioration of the display quality as in the second embodiment of the present invention.

Now, it will be described in more detail. As shown in FIG. 5, the timing controller 40 of an LCD according to the third embodiment of the present invention determines whether the vertical driving frequency of the LCD is changed (S501). The determination of the frequency change is based on an internal clock of the timing controller 40 or an external clock such as a ring oscillator.

Describing in more detail, the change of the vertical frequency can be determined by counting the length of the Vsync signal determining the length of one frame in synchronization with the internal clock or the external clock. That is, since the length of the clock is constant regardless of the vertical frequency, the vertical frequency is determined to be changed into 75 Hz if the measured count value is (C60×60/75) assuming the count value with 60 Hz is C60. Alternatively, it can be determined by counting the pulse width of an active period or an inactive period of a data enable signal (DE) in synchronization with these clocks, and the vertical frequency is determined to be changed when the count value is changed.

After determining whether the vertical frequency is changed, the LCD is driven in one-dot inversion if the vertical frequency is changed from 60 Hz to a higher value, and the inversion type is changed into two-dot inversion if the vertical frequency is changed from a higher value to 60 Hz (S502). If the vertical frequency is not changed or changed into another higher value, the inversion type of the LCD is maintained (S511).

As described in the second embodiment of the present invention, if the generation of the flicker is detected (S503), it is examined whether the current inversion type is one-dot inversion (S504). For one-dot inversion, the inversion type is changed into two-dot inversion to remove the flicker as described in the second embodiment of the present invention (S505). If the flicker is not generated or the current inversion type is two-dot inversion, the LCD maintains its inversion type without change (S512 and S513).

The third embodiment of the present invention drives an LCD in two-dot inversion for a vertical frequency of 60 Hz to reduce the power consumption, and drives the LCD in one-dot inversion to avoid the charging inequality for the frequency higher than 60 Hz. In addition, if the flicker is generated in one-dot inversion, it is changed into two-dot inversion to remove the flicker.

Although the third embodiment of the present invention determines the change of the vertical frequency based on the length of the Vsync signal or the DE signal, the determining way is not confined to this example.

The present invention prevents the deterioration of the image quality even for the LCD driven with the vertical frequency equal to or higher than 60 Hz. The two-dot inversion of the LCD with the vertical frequency higher than 60 Hz removes the horizontal lines generated due to the unequal charging. Moreover, the one-dot inversion of the LCD with the vertical frequency higher than 60 Hz prevents the generation of the flicker. In addition, the LCD with the vertical frequency equal to or higher than 60 Hz can be selectively driven in two-dot inversion or one-dot inversion.

While the present invention has been described in detail with reference to the preferred embodiments, it is to be understood that the invention is not limited to the disclosed embodiments, but, on the contrary, is intended to cover various modifications and equivalent arrangements included within the sprit and scope of the appended claims.

What is claimed is:

1. A liquid crystal display comprising:

a liquid crystal panel including a that data line and a plurality of second data lines extending parallel to each other in a column direction, a plurality of gate lines extending parallel to each other in a row direction, and a signal line extending in the row direction connected to the first data line; and a timing controller electrically connected to the first and the second data lines, the gate lines, and the signal line, the timing controller controlling timing of image signals and a selection signal respectively applied to the second data lines and the gate lines; and wherein the timing controller applies a first puke to the first data line, receives a second pulse as a delayed signal of the first pulse through the signal line, and measures a load of the second data line based on the delay between the first pulse and the second pulse, and a pulse width of a gate signal applied to a previous gate line is narrower than a pulse width of a gate signal applied to a current gate line adjacent to the previous gate line in case that polarities of the data signals applied to pixels connected to the previous and the current gate lines are opposite if the measured load is large than a predetermined value.

2. The liquid crystal display of claim 1, wherein the first data line includes a dummy data line.

3. The liquid crystal display of claim 1, wherein the first data line includes a data line transmitting an image signal and the signal line includes any one of the gate lines connected to the data line.

* * * * *